United States Patent [19]

Hanson

[11] 4,216,999

[45] Aug. 12, 1980

[54] MACHINE FOR MINING TAR SANDS HAVING REARWARDLY DIRECTED EXHAUST RELATED TO CONVEYOR TROUGH

[76] Inventor: Lester Hanson, 1903 Princeton Ave., Salt Lake City, Utah 84108

[21] Appl. No.: 951,591

[22] Filed: Oct. 16, 1978

[51] Int. Cl.[2] ..... E21C 27/24; E21C 35/20

[52] U.S. Cl. ..... 299/57; 299/18; 299/90

[58] Field of Search ..... 299/12, 57, 59, 91, 299/56, 18, 90, 64–68

[56] References Cited

U.S. PATENT DOCUMENTS

| | | | |
|---|---|---|---|
| 1,720,195 | 3/1921 | App | 299/90 X |
| 1,938,530 | 12/1933 | Moore | 299/91 |
| 2,776,123 | 1/1957 | Snyder | 299/59 |
| 2,776,126 | 1/1957 | Anderson | 299/57 X |
| 2,822,159 | 2/1958 | Joy | 299/56 X |
| 2,834,588 | 5/1958 | Boesewetter | 299/59 X |
| 2,836,408 | 5/1958 | Barrett | 299/56 |
| 3,005,627 | 8/1958 | Tincin | 29/18 X |
| 3,062,519 | 11/1962 | Osgood | 299/59 |
| 3,140,120 | 7/1964 | Ward | 299/59 X |
| 3,387,889 | 6/1968 | Ziemda et al. | 299/12 |
| 4,157,204 | 6/1979 | Kissell et al. | 299/64 |

*Primary Examiner*—Ernest R. Purser
*Attorney, Agent, or Firm*—M. Ralph Shaffer

[57] ABSTRACT

The present invention relates to mining machinery and presents a new an improved machine, and components therefor, suitable for mining tar sands and other soft materials such as soft coal, oil shale and so forth. The machine can be used both above ground and below ground, and is particularly suitable for underground mining, to take advantages, for example, of the absence to exposure to inclement weather, excessive moisture, and for other reasons. Underground mining use of the machine is particularly suitable since the tar sands will not freeze up when the mining function is accomplished below-grade. The machine itself has a cutting face comprising a series of cutting heads that may be rotated in the same direction, revolve at the same speed, and intermesh so as to provide for an effective solid cutting surface. The machine is provided with air compressor means for blow cuttings rearwardly of the machine through a provided trough carried by such machine. The deck or primary plate of the machine can be adjusted for incline or decline so that a variety of mining functions can be accomplished as will hereinafter be explained. The track drives are provided with means for advancing the machine forwardly, rearwardly, turning the same about a vertical axis, or indeed turning the machine in any desired manner. This is accomplished by a pair of variable speed motors, with gear boxes, that are supplied for driving the respective track drives on opposite sides of the machine.

3 Claims, 8 Drawing Figures

MACHINE FOR MINING TAR SANDS HAVING REARWARDLY DIRECTED EXHAUST RELATED TO CONVEYOR TROUGH

FIELD OF INVENTION

The present invention relates to mining machinery and, more particularly, provides a machine suitable for mining soft materials such as tar sands, soft coals possibly and other materials. The machine is unique in several provisions, and while primarily useful for mining tar sands, the same may be used for mining other types of soft materials. The machine is particularly suitable for use below-grade in underground mining operations. Particularly unique features in the present invention include the provision of a series of air jets for ejecting tar-sand cuttings, a variable platform control for controlling the orientation of the cutting face of the machine, and the cutting face itself comprising a series inter-meshed cutting heads as hereinafter described.

BRIEF DESCRIPTION OF PRIOR ART

Machines of a CATERPILLER tractor type are used in mining operations, both above and below ground, are of course in common use. None of the machines of which the inventor is aware are really suitable for tar-sand mining or the mining of some other types of soft materials. Additionally, it should be noted that in the winter-time, in states such as Utah and Colorado, above-ground mining of tar sands becomes impossible since these materials are frozen. It therefore is important to provide a machine useful not only in summer but also in winter, for underground mining operations wherein the tar sands below grade will not be frozen and can be easily mined.

The present invention is unique in the provision of an adjustable platform, an adjustable face for a variety of mining functions as hereinafter explained, and provides for air ejection of cut materials from the forward face and beneath the vehicle rearwardly, and also provides a cutting face composed of a series of inter-meshed cutters that are driven so as not to interfere with each other. The cutting heads have a series of projections suitably contoured, dimension, and oriented, for enabling maximum effectiveness of the respective tools. Accordingly, the components themselves are important.

No patents or other literature are presently known, teaching the concepts as above briefly outlined or in any way alludes thereto.

BRIEF DESCRIPTION OF THE INVENTION

According to the present invention the machine has a pair of endless track drives that are driven by respective, reversible, variable-speed electric motors. The tracks are operative in advancing forwardly and rearwardly such machine as well as turning the same at any desired rate about any vertical axis. Of importance is the inclusion of adjustable platform to which certain equipment is mounted and from which the cutting face structure extends. Accordingly, an angular adjustment may be made relative to the vertical disposition of the cutting face and the machine relative to its tracks. The purposes for this feature will be described hereinafter. Individual mining machine heads have a plurality of arms, with respective arms of the respective heads being intermeshed and driven suitably so there is no arm interference relative to such tools. Accordingly, a cutting structure is provided to obtain maximum cutting effectiveness relative to the face of the materials being cut or reduced. Air jets are supplied for removing cuttings, falling from the face being mined, in a direction rearwardly of the machine as the machine advances forwardly to the face of the materials being mined.

OBJECTS

Accordingly, a principal objective of the present invention is to provide a new and improved mining machine.

A further object is to provide a new mining machine, particularly suitable for mining tar sands and other soft materials.

An additional object is to provide a mining machine that is easily maneuverable both above and below ground.

An additional object is to provide a mining machine wherein the cutting face or structure thereof may be made adjustable relative to true vertical orientation.

An additional object is to provide for fluid-jet ejection, such as air-jet ejection, of cut materials from a mined face.

A further object is to provide for new and improved cutting equipment for a mining machine or vehicle.

BRIEF DESCRIPTION OF DRAWINGS

The features of the present invention which are believed to be novel are set forth with particularity in the appended claims. The present invention, both as to its organization and manner of operation, together with further objects and advantages thereof may best be understood by reference to the following description, taken in connection with the accompanying drawings in which:

DESCRIPTION OF PREFERRED EMBODIMENTS

Figure 2:
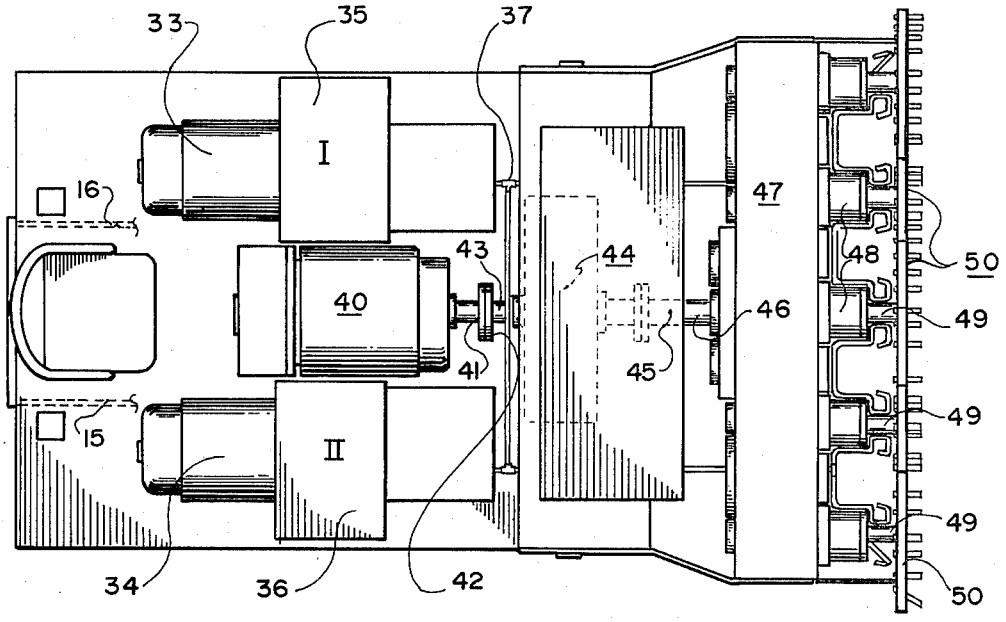
FIG. 2 is a top plan of the structure of FIG. 1.
Figure 1:
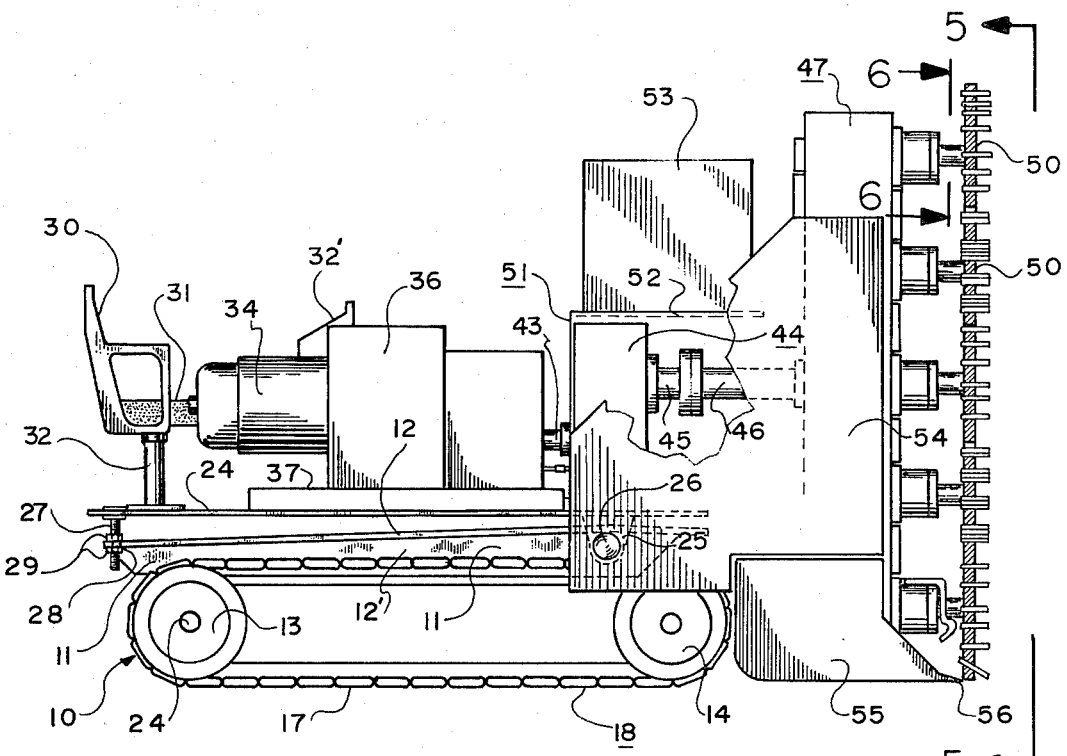
FIG. 1 is a side elevation, partially broken away for convenience of illustration, of a mining machine constructed in accordance with the principles of the present invention in a preferred embodiment thereof.

In FIG. 1 the vehicle 10 is shown to include a fixed frame 11 comprising a top plate 12 and provided with at least a pair of depending webs 12', one on each side of the frame. Depending from the frame on each side by conventional structure, not shown, will be a series of sprocket wheels 13 and 14.

Additionally, a pair of interior, web plate supports are of depending character at 15 and 16 and will be provided.

The pair of sprocket wheels 13 and 14, one each being provided at each side of the vehicle, respectively key into the endless track 17 of track drive 18.

The sprocket drives 13 on either side of the vehicle will be driven by respective, reversible, variable speeds electric motors 19 and 20 via their respective gear boxes 21 and 22. Sprocket shafts 23 and 24 will couple the outputs of the respective gear boxes to the two sprocket wheels 13.

Of special importance is the inclusion of a top plate 24 which has a pair of depending ears 25 that journal to a common, horizontal, cross-shaft 26. The shaft at 26 is fixed so that the top plate may be easily rotationally displaced about the axis of shaft 26. To secure the movable plate 24 in any fixed disposition, threaded stud 27 will be provided, the same passing through an aperture 28 in plate 12. Adjustment nuts 29 are provided so that a fore-aft tilt of plate 24 may be selected, relative to the fixed disposition of plate 12, which can be releasably held in place by the suitable adjustment of nuts 29.

An operator's station 30 is supplied and is provided with the usual seat 31. Upstanding post 32 attaches the operator's station to the top plate 34 in any convenient manner. There will be provided an operator's control panel 32' with a series of gauges, control switches and electric controls for driving and otherwise operating the vehicle with its equipment. The air-compressor electric motors 33 and 34 are supplied and drive respective air compressors 35 and 36, labeled numbers Nos. I and II. The air compressors with their motors are rigidly attached by any convenient manner to base 37 that performs an attachment to or a part of the top plate 24.

Figure 4:
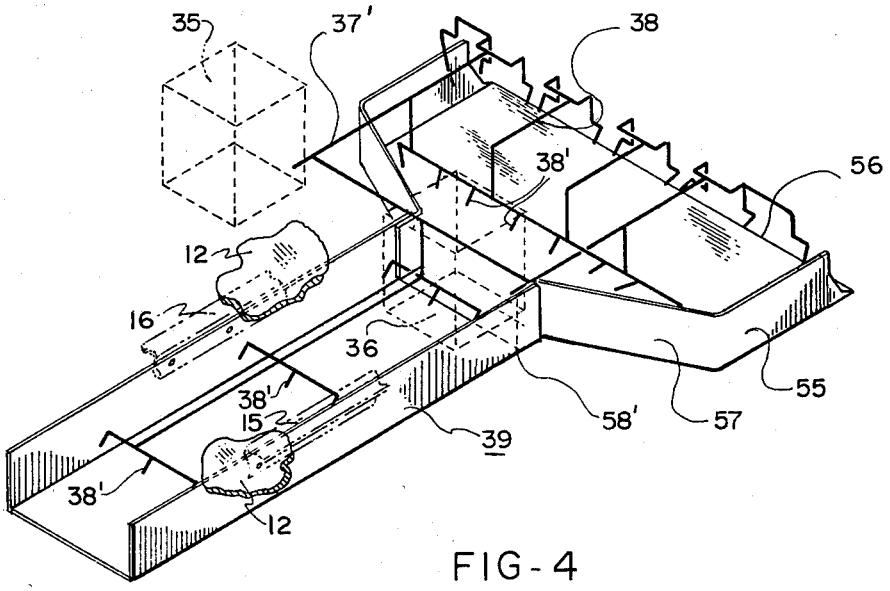
FIG. 4 is a perspective, diagrammatic view of the air jet equipment supplied the machine for ejecting cut materials rearwardly of the machine and underneath the same.
Figure 3:
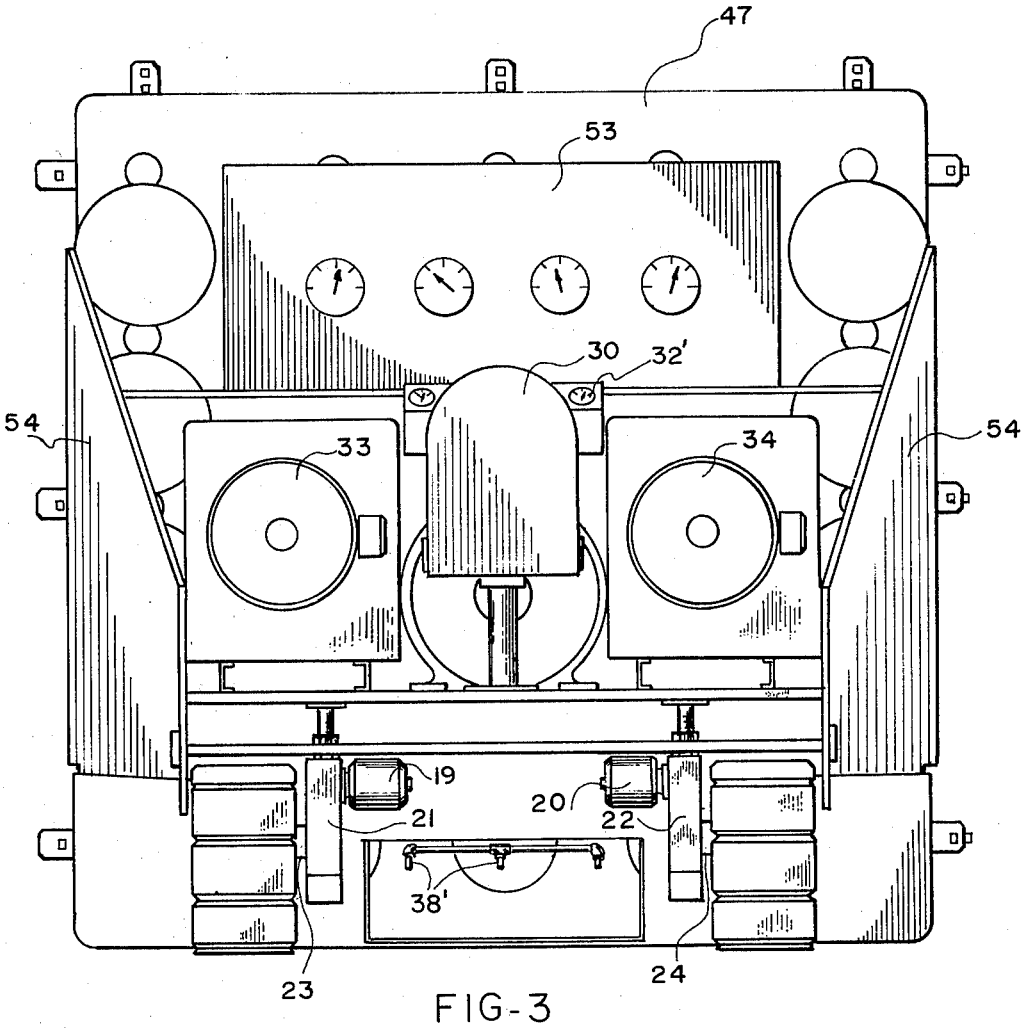
FIG. 3 is a rear view of the mining machine of FIG. 1.

Leading from the respective air compressors is conduit at 37' which accommodates the conduit blower ejection system 38, shown in FIG. 4, for air-impelling the cut tar-sand materials, by nozzles 38', toward the rear of the trough 39 provided the vehicle and moving therewith. Such trough 39 is supported from the bottom plate 12 of the vehicle by any conventional means.

An electric motor 40 is supplied an output shaft 41 that is coupled by clutch 42 to the input drive 43 of speed reducer 44, the same having an output drive shaft 45 connecting to the input 46 of gear box 47. Gear box 47 has a series of bearing supports 48, each of which supports a respective shaft 49 of a revolving mining machine head 50.

Figure 5:
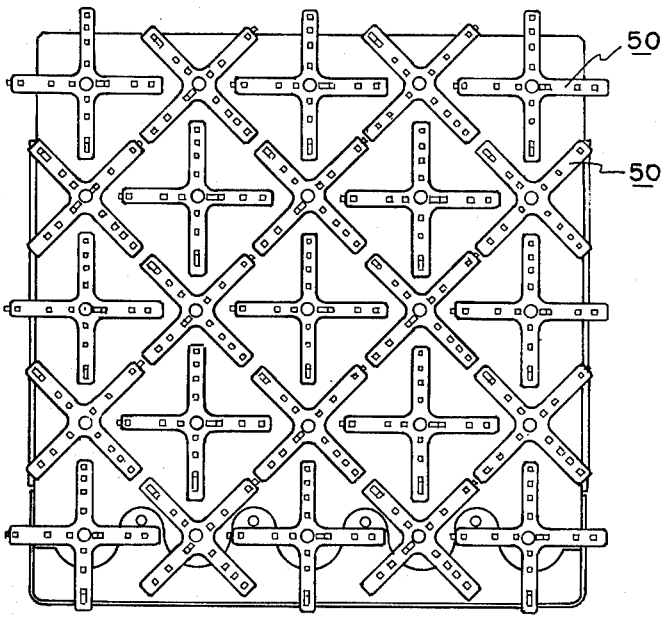
FIG. 5 is a front view of the machine and is taken along the line 5—5 in FIG. 1.

The gear box 47 will be of conventional construction including a series of gears, idlers and so forth so that a single input drive will produce a plurality of out-put drives in a matrix form as shown in FIG. 5.

Before pursuing a discussion of the mining machine heads and their operation, it is best to complete a general description of the vehicle without regard to the latter. In particular, a housing 51, having shell 52, will be provided, see FIG. 1, for supporting the housing 53 comprising the electrical control equipment needed. Opposite plates 54 are secured to top plate 24. The two side plates 54, one being shown in FIG. 1, in conjunction with the bottom side plate 55, move about the axis of shaft 26 in accordance with the adjustment of top late 24 by nuts 29.

Sides 55 form the part of a scoop 56. The scoop 56 is integral with the opposite side plates 55 which tend to converge toward each other at portions 57. There will be a break, however, at 58' so that the trough at 39 will remain fixed relative to bottom plate 12 whereas the scoop portion fitting within the forward end of the trough will be movably adjustable in accordance with the positionment of top plate 24.

The operation of the equipment as thus far described is as follows: Electric motors 19 and 20 will drive the track drives on either side of the vehicle. Separate controls will be provided so that the unit may go forward, in a reverse direction, or may turn by one track being driven in one direction and the other track being driven in the opposite direction.

While the air compressor system need not be exclusively so used, the primary purpose of including the compressors with their motors is to provide blasts or jets of fluid (liquid or gas) such as air, as shown in the system seen in FIG. 4, for advancing and ejecting the tar sands that have been removed, i.e. cut from the face of the drift being mined, thus removing these rearwardly from the movable or scoop portion at 56 back to the fixed trough portion at 59 and rearwardly therefrom out the rear of the machine.

Consideration will now be given to the mining machine heads 50 respectively attached and keyed to the respective shafts 49. Reference is now made to FIGS. 5–8. At the outset, it is to be noted that these mining machine heads are staggered in a manner as illustrated generally in FIG. 5, by way of example, so that upon the simultaneous rotation of all of the shafts 49 at the same speed and in the same direction the mining machine heads will rotate about their axis and yet never impinge upon or hit each other. This can be done where the ultimate mining machine heads are disposed nominally in the same direction, and intermediate heads are disposed to be rotationally displaced 45°. This would apply in a situation where there are four arms to each head arranged in quadrature. Alternatively, of course, they are somewhat less effectively, but three arms spaced 60° apart may be provided, in which event the displacement of the intermediate mining heads would be 30°. It is far more effective, however, to use the quadrature-arranged arm construction for the several mining heads as shown in FIG. 5. Again, the shafts 49 will be all rotated at the same speed so as to revolve the mining machine cutting heads about their own axis at equivalent speeds, and this in a manner such that the heads never do interfere with each other, provided, of course, that the mining machine heads not only rotate at the same speed but also in the same direction, by way of example.

Figure 7:
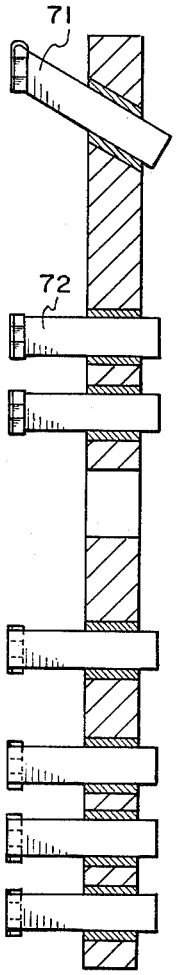
FIG. 7 is an enlarged section taken along the line 7—7 in FIG. 6.
Figure 6:
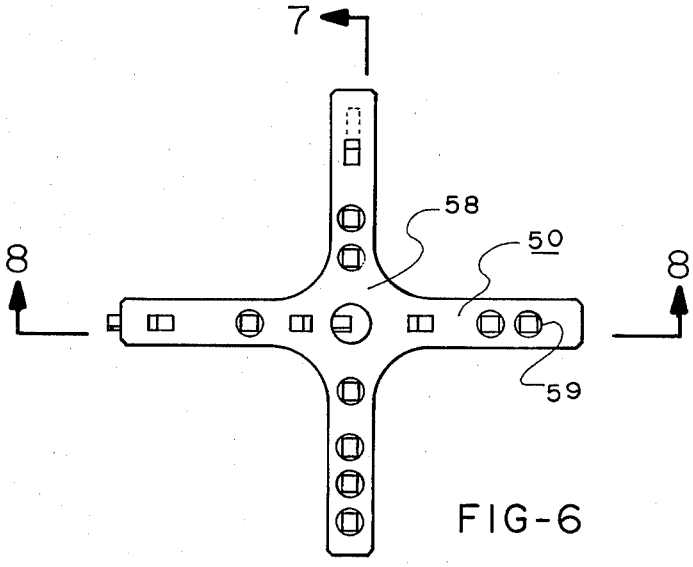
FIG. 6 is an enlarged rear view of a representative mining machine head employed in the invention, secured to a respective revolving shaft thereof, and taken along the line 6—6 in FIG. 1.
Figure 8:
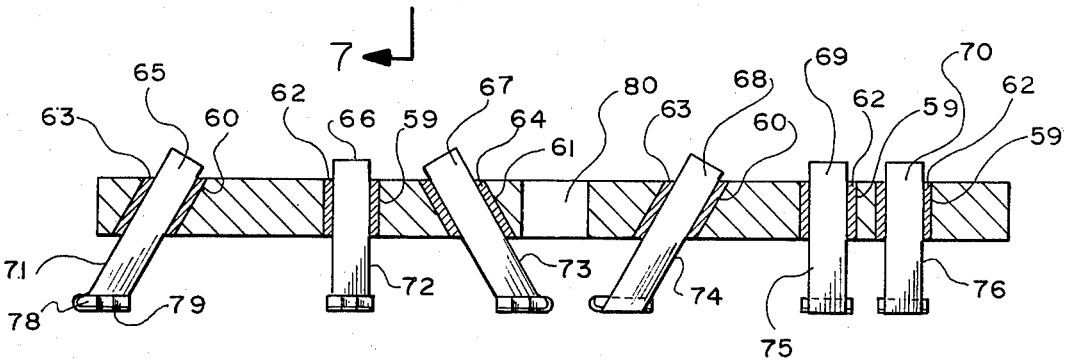
FIG. 8 is an enlarged section taken along the line 8—8 in FIG. 6.

As to the construction of the individual mining machine head, the reader is referred to FIGS. 6–8. Each mining machine head will include a base 58 having a series of round apertures 59, 60 and 61, in straight and respectively angulated orientation. Each of these apertures is lined with a respective round-to-square inserts at 62–64. The square, internal apertures of the inserts respectively receive shanks 65–70 of the respective tar-sand cutting tools 71–76.

Each of these tools is provided, in addition to the shank, a cutting tool head 77 formed of a carbide substrate 78 and a synthetic diamond layer 79, for example. A suitable cutting head would be that going under the tradename STRATAPAX manufactured by the General Electric Company. These STRATAPAX products are available in a variety of shapes and sizes and consist of manufactured polycrystalline diamonds bonded to a brazed-in-place tungsten carbide substrate, as for example, the substrate 78. See products numbers 2325–2338.

Preferred in the construction is the employment of product numbers 2536 and 2538.

It is noted in FIG. 8 that the interior tool 73 cuts a small circle that completely cuts the central portion of the face against which the tool is advancing; this is so that the presence of the shaft in shaft aperture 80 with rotation axix A will detract from the material that is being cut directly forwardly of and in line with the shaft.

The outer tool on the left hand side as seen in FIG. 8 at 71 cuts a wide circle that is the largest cutting circle for that particular mining machine head. It will be seen, from a consideration of all of the mining machine heads as shown in FIG. 5, that the entire face of the tar sands will be completely cut by the advancing rotating cutting tools.

The matrix of the cutting tools is seen in FIG. 5. Each individual tool will be formed as that shown in FIGS. 6–8 which constitutes a representative one of such tools.

In operation, the cutting-face tilt feature of the equipment is especially useful when the machine progresses along one support plane to a second plane angulated relative to the first. Also, as the machine is advancing through the drift or tunnel, the floor thereof is generally pitched at a slight angle so that any moisture will run rearwardly from the tunnel. An added purpose is that as a second run is being made in the drift at a slightly declining angle, then the cutting face of the equipment can be adjusted to compensate for such decline at an angle so that the face still remains essentially perpendicular and in line with the original face cut. Correspondingly, once the level is reached such that the machine should be "straightened up" so to speak, then the cutting face of the machine can be adjusted so that the face remains at the same vertical angle at which it was originally being cut. This provides for great versatility in use of the machine in going back and forth in the existing drift and the vertical enlargement thereof as will take place in the mining operation.

Further, the adjustment comes into play when a person has just descended along a decline and then reaches the point at which the bottom of the drift or tunnel is to be straightened up. At that point, the cutting face of the machine can be adjusted so that he can continue on to cut the face of the tar sand in the same direction as he was previously. This feature is useful in another operation wherein an operator wishes to go, for example, up along one inclined ramp to then level off for travel along a new floor plane.

What is provided therefore is a new and unique mining machine suitable for mining tar sand, possibly soft coals or other soft materials. The machine is adapted not only for use underground, but also above ground as well. A great advantage, of course, is using the machine underground at constant temperatures where inclement weather is avoided.

While particular embodiments of the present invention have been shown and described, it will be obvious to those skilled in the art that changes and modifications may be made without departing from this invention in its broader aspects, and therefore, the aim in the appended claims is to cover all such changes and modifications as fall within the true spirit and scope of this invention.

I claim:

1. A mining machine having a main frame, endless track means supporting said main frame, a platform supported by and pivoted to said main frame for incremental adjustment as to fore and aft disposition, an operator's station provided on said platform, power drive means also provided on said platform, a series of forwardly-facing, revolvable, intermeshed, mining machine heads coupled to and simultaneously revolved by said power means for cutting into minable materials, conveyor means comprising a longitudinal conveyor trough attached to and suspended beneath said main frame and a trough-like scoop movably fitting into said trough, attached to and suspended from said platform and in part disposed beneath said mining machine heads, said platform including pressured fluid means provided with essentially rearwardly directed exhaust jet means proximate to and cooperating with said conveyor trough and scoop for propellingly urging mined cuttings rearwardly there-through for expelling the same.

2. The structure of claim 1 wherein said scoop is disposed essentially underneath said mining machine heads for receiving mined material, said exhaust jet means also being disposed proximate said scoop for ejecting materials rearwardly therefrom.

3. The structure of claim 1 wherein said pressured-fluid means comprises air-compressor means.

* * * * *